US009891000B2

(12) United States Patent
Moller

(10) Patent No.: US 9,891,000 B2
(45) Date of Patent: Feb. 13, 2018

(54) CENTER HEATING ELEMENT FOR A VACUUM HEAT TREATING FURNACE

(71) Applicant: IPSEN, INC., Cherry Valley, IL (US)

(72) Inventor: Craig A. Moller, Roscoe, IL (US)

(73) Assignee: Ipsen, Inc., Cherry Valley, IL (US)

( * ) Notice: Subject to any disclaimer, the term of this patent is extended or adjusted under 35 U.S.C. 154(b) by 742 days.

(21) Appl. No.: 14/456,314

(22) Filed: Aug. 11, 2014

(65) Prior Publication Data

US 2015/0049781 A1 Feb. 19, 2015

Related U.S. Application Data

(60) Provisional application No. 61/866,178, filed on Aug. 15, 2013.

(51) Int. Cl.
*H05B 3/62* (2006.01)
*H05B 3/66* (2006.01)
(Continued)

(52) U.S. Cl.
CPC ..... *F27D 7/06* (2013.01); *F27B 5/14* (2013.01); *F27D 11/02* (2013.01);
(Continued)

(58) Field of Classification Search
CPC . F27D 7/06; F27D 11/00; F27D 11/02; F27D 99/0006; F27D 2007/066;
(Continued)

(56) References Cited

U.S. PATENT DOCUMENTS 2,916,535 A * 12/1959 Marden ..... H05B 3/62 373/110
4,246,434 A 1/1981 Gunther et al.
(Continued)

FOREIGN PATENT DOCUMENTS

CN 101881556 11/2010
CN 201772726 3/2011
(Continued)

OTHER PUBLICATIONS

European Search Report, EP Appln No. 14002818.4, Jan. 29, 2015, pp. 1-3.

*Primary Examiner* — Hung D Nguyen
(74) *Attorney, Agent, or Firm* — Dann, Dorfman, Herrell and Skillman, P.C.

(57) ABSTRACT

A vacuum heat treating furnace for the heat treatment of metal parts includes a pressure vessel and a hot zone enclosure that defines a hot zone therein. A heating element array inside the hot zone enclosure includes a first heating element, a second heating element, and a center heating element. The first and second heating elements are suspended on opposing sides of the hot zone enclosure. The center heating element is suspended vertically from the hot zone enclosure between the first and second heating elements. The center heating element is adapted to be connected to the first and second heating elements to form a continuous circuit therewith. The center heating element may be connected to the first and second heating elements with removable/reusable fasteners to provide for reconfiguration of the hot zone to accommodate different size workloads.

10 Claims, 6 Drawing Sheets

(51) Int. Cl.

| | |
|---|---|
| ***H05B 3/10*** | (2006.01) |
| ***F27D 7/06*** | (2006.01) |
| ***F27B 5/14*** | (2006.01) |
| ***F27D 11/02*** | (2006.01) |
| ***F27D 99/00*** | (2010.01) |

(52) U.S. Cl.
CPC .... *F27D 99/0006* (2013.01); *F27D 2007/066* (2013.01); *Y10T 29/49117* (2015.01)

(58) Field of Classification Search
CPC ..... F27B 5/14; Y10T 29/4911; H05B 3/06; H05B 3/10; H05B 3/16; H05B 3/24; H05B 3/32; H05B 3/62; H05B 3/64; H05B 3/66
USPC ..... 373/110, 117, 118, 119, 120, 123–125, 373/127, 128, 130, 131, 132, 133, 134, 373/129, 109; 219/402, 408, 410, 390, 219/552, 403, 406, 395
See application file for complete search history.

(56) References Cited

U.S. PATENT DOCUMENTS

| | | | | |
|---|---|---|---|---|
| 5,502,742 | A * | 3/1996 | Kellogg | F27B 5/16 373/128 |
| 6,307,874 | B1 * | 10/2001 | Moller | H05B 3/64 373/117 |
| 7,759,618 | B2 * | 7/2010 | Beatson | H05B 3/148 219/552 |
| 2006/0175316 | A1 | 8/2006 | Smith | |

FOREIGN PATENT DOCUMENTS

| | | |
|---|---|---|
| EP | 2610354 | 7/2013 |
| EP | 2610570 | 7/2013 |
| JP | 10103874 | 4/1998 |

* cited by examiner

CENTER HEATING ELEMENT FOR A VACUUM HEAT TREATING FURNACE

CROSS-REFERENCE TO RELATED APPLICATION

This application claims the benefit of U.S. Provisional Patent Application No. 61/866,178, filed Aug. 15, 2013, the entirety of which is incorporated herein by reference.

BACKGROUND OF THE INVENTION

Field of the Invention

This invention relates generally to vacuum heat treating furnaces and in particular to a heating element arrangement for a vacuum heat treating furnace.

Description of the Related Art

Prior to the present invention, a center heating element arrangement was used in a vacuum aluminum brazing furnace manufactured by Ipsen Inc., the assignee of the present application. A center heating element is a heating element bank that is positioned between two separate workloads inside a vacuum furnace. This arrangement allows for faster and more uniform heating of such loads because when the load is split into two sections, the center heating element radiates heat toward the inside-facing surfaces of the workloads while the peripheral heating elements radiate heat toward the outside-facing surfaces of the workloads. This has only been accomplished in the past by providing the center element bank with its own dedicated power terminals, variable reactance transformer power supply, and a thermocouple for effecting temperature control.

The known center heating element arrangement leaves something to be desired with respect to design and operational flexibility. The requirement for a separate power supply complicates the power supply requirements for the vacuum furnace and results in a more costly design. That design also requires more penetrations in the furnace wall. Also, the fixed-in-place nature of the known arrangement prevents the vacuum furnace from being used for larger-size workloads.

In view of the foregoing, it would be desirable to have a vacuum heat treating furnace that avoids the undesirable aspects of the known arrangement for a center heating element, while still providing the benefits of a center heating element. Moreover, it would also be desirable to have a vacuum heat treating furnace having a center heating element that does not have its own connections outside the vacuum furnace, no separate power transformer, and no separate control thermocouple. It is further desirable to provide a vacuum heat treating furnace having a center heating element that is readily removable so that work loads of different sizes can be heat treated in the furnace.

SUMMARY OF THE INVENTION

In accordance with the present invention there is provided a vacuum heat treating furnace for the heat treatment of metal parts that includes a pressure/vacuum vessel, a hot zone enclosure positioned inside the pressure vessel to define a hot zone within the heat treating furnace, a heating element array positioned inside said hot zone enclosure, and a source of electric power for energizing the heating element array. In the vacuum heat treating furnace of this invention, the heating element array includes a first heating element, a second heating element, and a third or center heating element. The first heating element is suspended on an inner wall of the hot zone enclosure in a first region of the hot zone. The first heating element has a first end and a second end and the first end is connected to the source of electric power. The second heating element is suspended on the inner wall of the hot zone enclosure in a second region of the hot zone opposite to the first region. The second heating element has a first end and a second end and the first end is connected to the source of electric power.

The center heating element is suspended from the inner wall of the hot zone enclosure along a vertical chord or diameter of the hot zone. The center heating element has first and second ends. First and second connection terminals are provided at the first end of the center heating element. The first connection terminal is connected to the second end of the first heating element and the second connection terminal is connected to the second end of the second heating element. In this manner, the center heating element is connected to the source of electric energy through said first and second heating elements. The heating element array further includes a support member having a first end attached to the hot zone enclosure and a second end connected to the second end of the center heating element for supporting the center heating element in the furnace hot zone.

In accordance with another aspect of the present invention, the heating element array is provided with a first removable/reusable fastener that attaches the first terminal connection to the second end of the first heating element and a second removable/reusable fastener that attaches the second terminal connection to the second end of the second heating element.

In accordance with a further aspect of the present invention the heating element array is provided with a third removable/reusable fastener that attaches a first end of the first sub-element to the second end of the first heating element and a fourth removable/reusable fastener that attaches the first end of a second sub-element to the second end of the second heating element.

In accordance with a still further aspect of the present invention, the vacuum heat treating furnace of this invention includes two or more heating element arrays as described above that are arranged in spaced coaxial relation along the length of the furnace hot zone.

In accordance with a further aspect of the present invention there is provided a method for configuring a vacuum heat treating furnace for holding different size workloads. The method is implemented with a vacuum heat treating furnace that has a pressure/vacuum vessel, a hot zone enclosure positioned inside said pressure vessel to define a hot zone within the heat treating furnace, a heating element array positioned inside said hot zone enclosure, and a source of electric energy. The heating element array includes a first heating element suspended on an inner wall of the hot zone enclosure in a first region of the hot zone. The first heating element has a first end and a second end and the first end is connected to the source of electric energy. The heating element array also includes a second heating element suspended on the inner wall of the hot zone enclosure in a second region of the hot zone opposite to the first region. The second heating element has a first end and a second end and the first end is connected to the source of electric energy. The heating element array further includes a center heating element suspended from the inner wall of the hot zone enclosure along a vertical chord of the hot zone. The center heating element has first and second connection terminals at a first end thereof and a second end. The first connection terminal is connected to the second end of the first heating element and the second connection terminal is connected to the second end of the second heating element. In this manner the center heating element is connected to the source of electric energy through the first and second heating elements. The heating element array further includes a hanger assembly having a first end attached to the hot zone enclosure and a second end connected to the second end of the center heating element. The method includes the steps of disconnecting the center heating element from the first and second heating elements, removing the center heating element from the vacuum heat treating furnace, and then connecting a jumper heating element between the second end of the first heating element and the second end of the second heating element, whereby an electrical conduction path is established between the first and second heating elements.

BRIEF DESCRIPTION OF THE DRAWINGS

The foregoing summary as well as the following detailed description will be better understood by referring to the drawings wherein.

DETAILED DESCRIPTION

Figure 1:
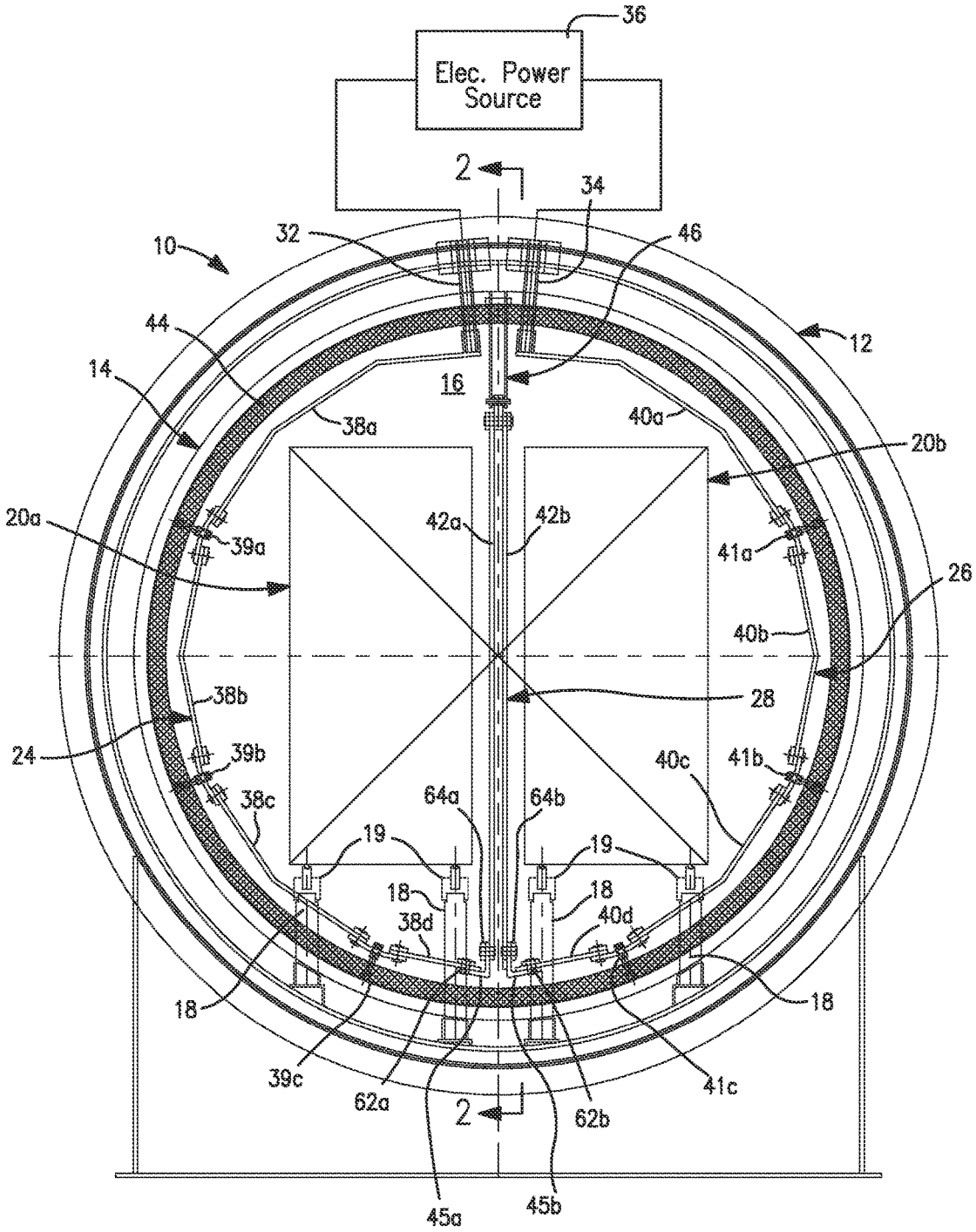
FIG. 1 is an end elevation view of a vacuum heat treating furnace according to the present invention.
Figure 2:
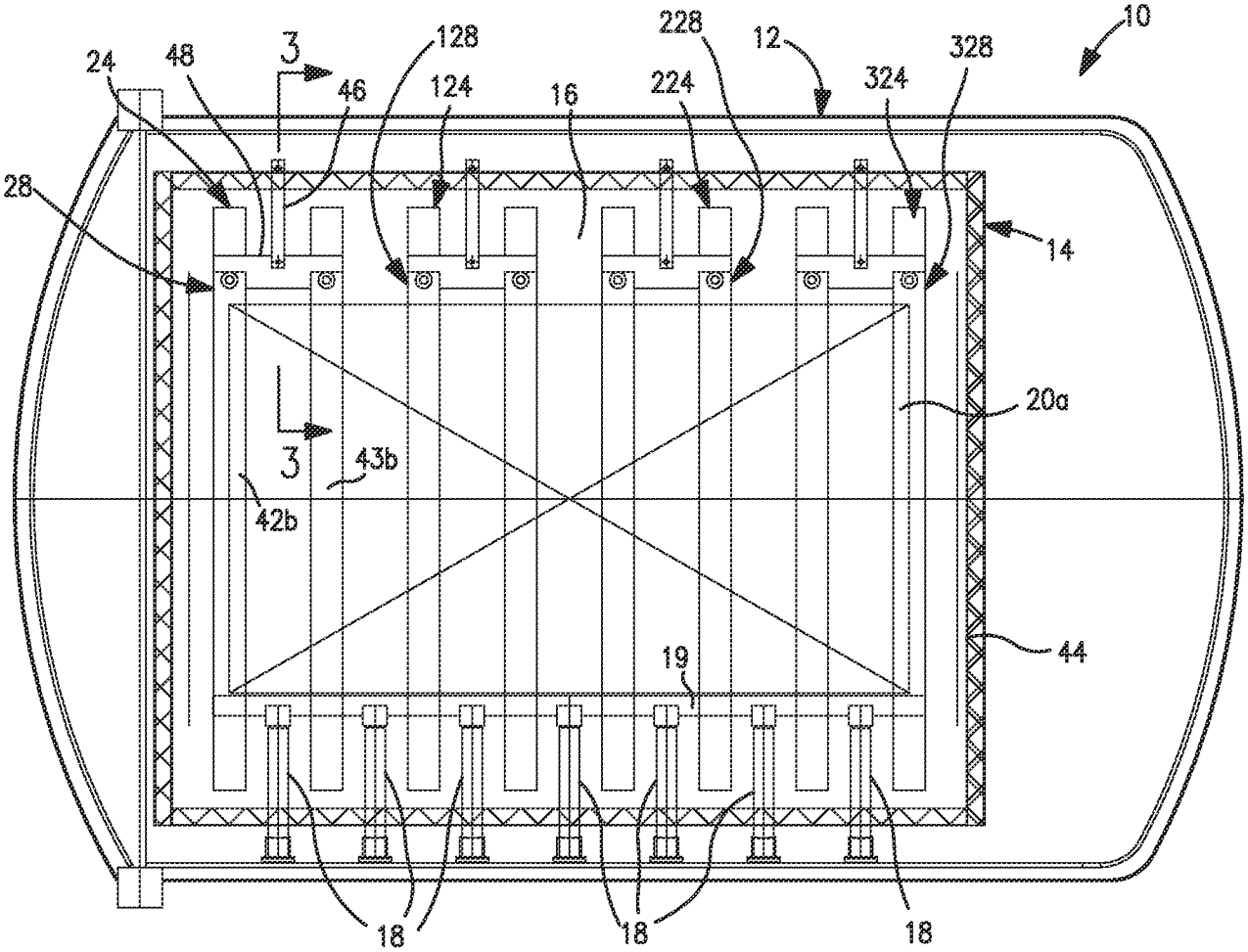
FIG. 2 is a side elevation view in partial cross section of the vacuum heat treating furnace shown in FIG. 1 as viewed along line 2-2 thereof.

Referring now to the drawings and in particular to FIGS. 1 and 2, there is shown an embodiment of a vacuum heat treating furnace (vacuum furnace) 10 according to the present invention. The vacuum furnace 10 includes a pressure/vacuum vessel 12 that is designed in the known manner to withstand levels of superatmospheric pressure and subatmospheric pressure that are used for a typical vacuum heat treating cycle. A hot zone enclosure 14 is mounted inside the pressure/vacuum vessel 12. Hot zone enclosure 14 is formed of a heat resisting and/or a heat reflecting material that has sufficient rigidity for the enclosure to maintain its shape. The hot zone enclosure is attached to the interior wall of the pressure/vacuum vessel 12 in any known manner. The hot zone enclosure 14 may have any desired cross-sectional geometry including circular, as shown in FIG. 1, and polygonal geometries. Hot zone enclosure 14 defines a hot zone 16 in the vacuum furnace 10. Hot zone 16 is dimensioned to accommodate therein one or more workloads 20*a*, 20*b*. The workloads 20*a*, 20*b* are supported on rails 19 that are each supported by a plurality of rail supports 18 that extend from the bottom of the pressure/vacuum vessel 12, through the hot zone enclosure 14, and into the hot zone 16.

Vacuum furnace 10 also has one or more heating element arrays or banks to provide radiant heat within the hot zone 16. As shown in FIG. 1 a heating element array according to the present invention includes a first lateral heating element 24, a second lateral heating element 26, and a third or center heating element 28. First lateral heating element 24 is positioned in a lateral region of the hot zone 16 and second lateral heating element 26 is positioned in a second lateral region of the hot zone 16 that is diametrically opposite to the first lateral region. The first lateral heating element 24 and the second lateral heating element 26 are shaped to conform generally to the shape of the hot zone enclosure 14. The center heating element 28 is positioned along a vertical chord of the hot zone 16 that is centrally located between the first and second lateral heating elements. Preferably, the center heating element is positioned along the vertical diameter of the hot zone. For some applications it may be desirable to have the center heating element located off the diameter of the hot zone, for example, to accommodate two different size workloads.

First lateral heating element 24 includes heating element segments 38*a*, 38*b*, 38*c*, and 38*d*. The heating element segments 38*a* and 38*b* are connected together at a first heating element support 39*a*. Heating element segments 38*b* and 38*c* are connected together at a second heating element support 39*b* and heating element segments 38*c* and 38*d* are connected together at a third heating element support 39*c*. The heating element supports 39*a*, 39*b*, and 39*c* extend from and are attached to the hot zone enclosure 14 at spaced intervals as shown. Second lateral heating element 26 includes heating element segments 40*a*, 40*b*, 40*c*, and 40*d*. The heating element segments 40*a* and 40*b* are connected together at a first heating element support 41*a*. Heating element segments 40*b* and 40*c* are connected together at a second heating element support 41*b* and heating element segments 40*c* and 40*d* are connected together at a third heating element support 41*c*. The heating element supports 41*a*, 41*b*, and 41*c* extend from and are attached to the hot zone enclosure 14 at spaced intervals as shown.

First lateral heating element 24 is connected at one end to a first terminal connector 32 that extends through the hot zone enclosure and through the wall of the pressure/vacuum vessel 12. Likewise, second lateral heating element 26 is connected at one end to a second terminal connector 34 that also extends through the hot zone enclosure and through the pressure/vacuum vessel wall. The other ends of the first and second terminal connectors 32, 34 are adapted to be connected to a source of electric power 36. Arrangements for such power sources and suitable connections therefor are known to persons skilled in the art and no special design is needed for the arrangement according to the present invention. However, it is an advantage of the present invention that fewer power sources are needed for the heating element arrangement according to this invention than would be needed for the known heating element arrangements that include a center heating element.

The center heating element 28 is formed of a first heating element segment 42*a* and a second heating element segment 42*b*. First heating element segment 42*a* has a connection terminal 45*a* at a first end thereof whereby the first heating element segment 42*a* is connected to the first lateral heating element 24. Second heating element segment 42*b* has a connection terminal 45*b* at a first end thereof whereby the second heating element segment 42*b* is connected to the second lateral heating element 26. The first and second heating element segments 42*a* and 42*b* are connected to each other at second ends thereof as described in more detail below. In this manner the center heating element 28 provides a continuous conductive path between the first and second lateral heating elements 24 and 26. With the foregoing arrangement, the center heating element 28 is connected to the electric power source 36 through the first and second heating elements 24, 26 and forms a complete electrical circuit therewith.

In the embodiment shown in FIG. 2, the center heating element 28 preferably includes a second pair of heating element segments 43*a*, 43*b* of which heating element segment 43*b* is one member. The second ends of the heating element segments 42*a* and 42*b* of the center heating element 28 are connected together by means of a support connector 48. Heating element segments 43*a* and 43*b* are also connected to the support connector 48 in spaced relation to the heating element segments 42*a*, 42*b*. The support connector 48 is connected to one end of a heating element hanger assembly 46 that extends from and is attached to the hot zone enclosure 14. The support arrangement for the center heating element 28 is shown in more detail in FIG. 3.

Figure 3:
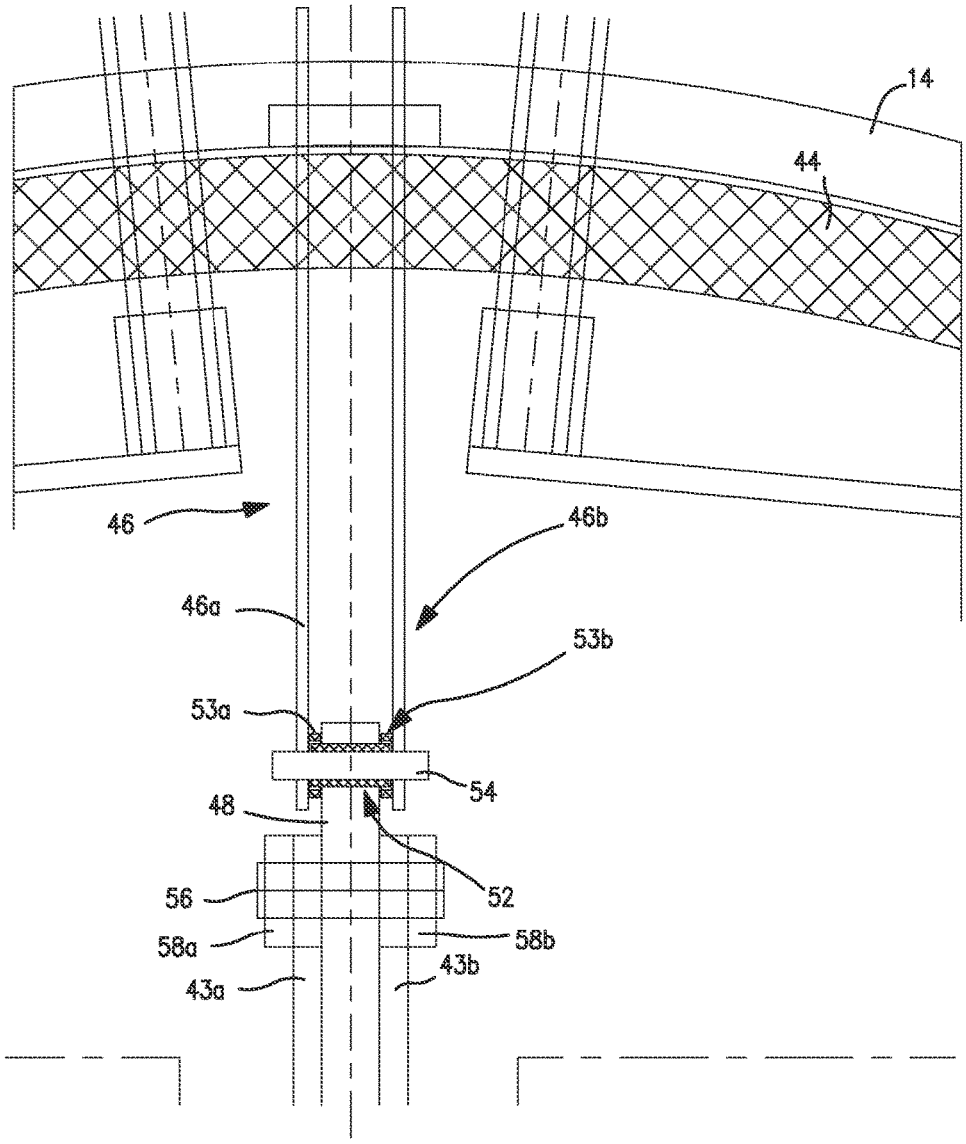
FIG. 3 is a detail view of a hanger assembly for a center heating element used in the vacuum heat treating furnace of FIG. 1 as viewed along line 3-3 thereof.

As shown in FIG. 3, the hanger assembly 46 is preferably formed of two bar segments 46*a* and 46*b* which are arranged in spaced parallel relation to each other. First ends of the bar segments 46*a* and 46*b* are attached to the hot zone enclosure 14 by any suitable means. Second ends of the bar segments 46*a* and 46*b* are attached to the support connector 48. In the preferred arrangement shown, a pin 54 is inserted through aligned holes in the ends of bar segments 46*a* and 46*b* and in the support connector 48. In order to provide electrical isolation between the support connector 48 and the hanger assembly 46, a ceramic bushing or sleeve 52 is positioned around a central portion of pin 54 that extends through the pin hole of support connector 48. In addition, ceramic ring spacers or collars 53*a* and 53*b* are disposed around the pin 54 on either side of the support connector 48. Preferably, spacer 53*a* is located between one side of support connector 48 and bar segment 46*a*. Spacer 53*b* is located between the other side of support connector 48 and bar segment 46*b*. The heating element segments of the center heating element 28 are attached to the support connector 48. In the embodiment shown in FIG. 3, a threaded graphite stud 56 extends through aligned holes in the ends of the heating element segments 43*a* and 43*b* and in the support connector 48. The threaded stud 56 is held in position by means of graphite nuts 58*a* and 58*b* threaded to each end of the stud 56. Stud 56 and support connector 48 are formed of a conductive material, preferably graphite, to provide a conductive path between the heating element segments 43*a* and 43*b*. Although not shown in FIG. 3, the heating element segments 42*a* and 42*b* are connected to the support connector 48 in a similar manner.

Referring back to FIG. 1, connection terminal 45*a* is attached to heating element segment 38*d* by means of a removable/reusable fastener 62*a*. Likewise, connection terminal 45*b* is attached to heating element segment 40*d* by means of a removable/reusable fastener 62*b*. Connection terminal 45*a* is attached to heating element segment 42*a* by means of a removable/reusable fastener 64*a* and connection terminal 45*b* is attached to heating element segment 42*b* by means of a removable/reusable fastener 64*b*. The removable/reusable fasteners 62*a*, 62*b*, 64*a*, and 64*b* are preferably embodied as a combination of a threaded graphite stud and corresponding graphite nuts as described above. In this arrangement the threaded studs extend through aligned holes in the connection terminals and the corresponding heating element segments. The nuts are threaded onto the opposing ends of the threaded stud and tightened to complete the connection. Other types of removable/reusable fasteners known to those skilled in the art can also be used. In an alternative embodiment, the connection terminals 45*a*, 45*b* can be formed integrally with the heating element segments 42*a* and 42*b*, respectively, such that the removable fasteners 64*a* and 64*b* would not be needed.

Referring now to FIGS. 6-9, there is shown an alternate arrangement for the center heating element array according to the present invention. In the arrangement shown in FIGS. 6-9, the center heating element array includes a plurality of heating elements 128*a*-128*h* arranged in side-by-side relation along the length of the vacuum furnace hot zone. Each heating element 128*a*-128*h* is attached to a hanger assembly 110*a*-110*h*, respectively. Heating element 128*a*, which is typical, includes first and second heating element segments 142*a* and 142*b*. In the same manner as described above, heating element segments 142*a* and 142*b* are connected at respective first ends thereof. Heating element segment 142*a* has a connecting segment 138*d* and heating element segment 142*b* has a connecting segment 140*d*. In the embodiment shown in FIGS. 6-9, a first end of connecting segment 138*d* is attached to a second end of heating element segment 142*a* by means of a removable/reusable fastener as described above. A second end of connecting segment 138*d* is adapted to be connected to the first heating element 24 by means of a removable/reusable fastener. A first end of connecting segment 140*d* is attached to a second end of heating element segment 142*b* by means of a removable/reusable fastener. A second end of connecting segment 140*d* is adapted to be connected to the second heating element 26 by means of a removable/reusable fastener.

In accordance with an aspect of this invention, the center heating element 28 is removably connected to the first and second lateral heating elements 24 and 26 so that the center heating element 28 can be removed when needed in order to permit a single large workload to be heat treated in the vacuum furnace 10. The use of removable/reusable fasteners to attach the heating element segments 42*a* and 42*b* to respective heating element segments 38*d* and 40*d* is preferred to facilitate the removal and reinstallation of the third heating element 28. This arrangement provides greater flexibility for the user of the vacuum furnace according to the invention with respect to the sizes of workloads that can be accommodated in one vacuum furnace.

Figure 4:
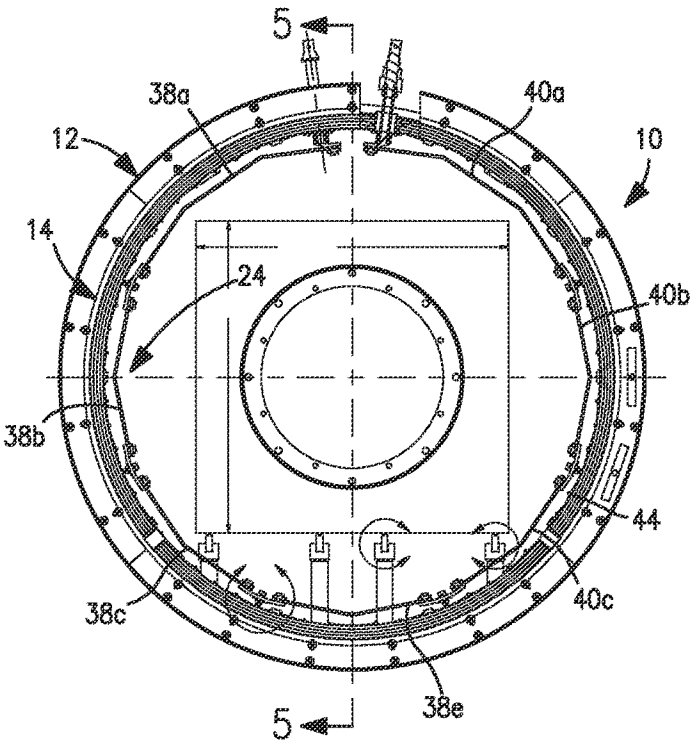
FIG. 4 is an end elevation view of a vacuum heat treating furnace according to the present invention with the center heating element removed.
Figure 9:
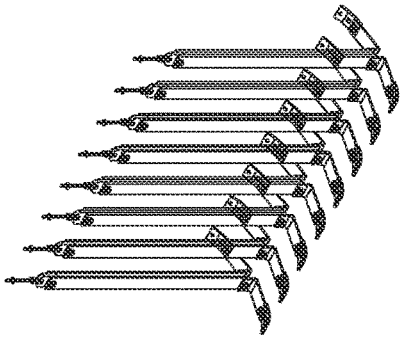
FIG. 9 is a perspective view of the center heating element array of FIG. 6.
Figure 7:
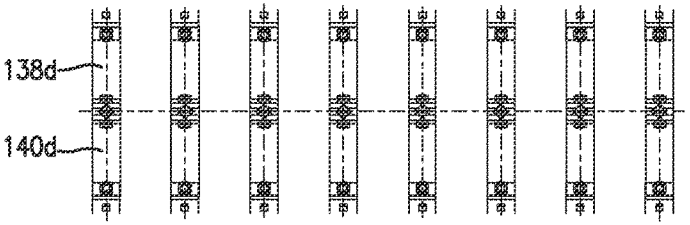
FIG. 7 is a top plan view of the center heating element array of FIG. 6.
Figure 6:
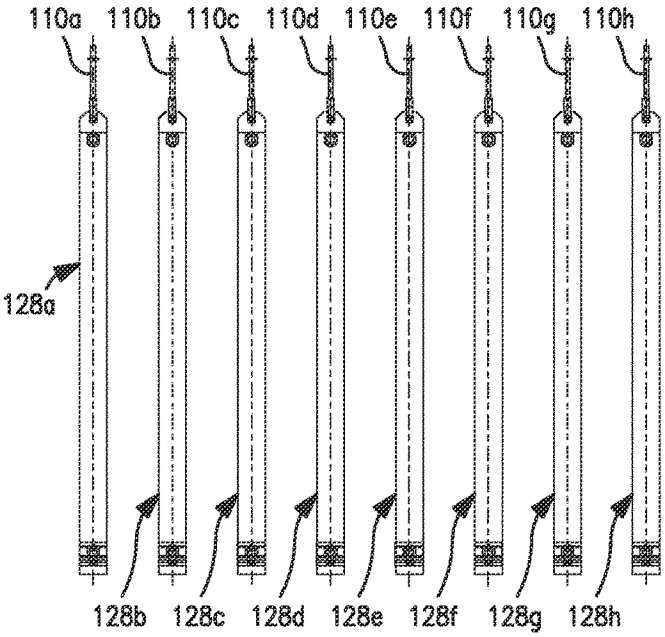
FIG. 6 is a schematic view of an alternate arrangement of a center heating element array according to the present invention.
Figure 8:
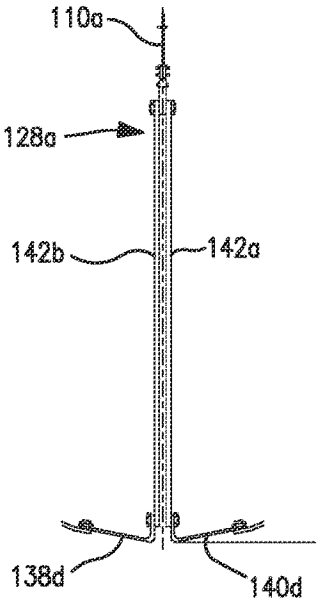
FIG. 8 an end elevation view of the center heating element array of FIG. 6.
Figure 10:
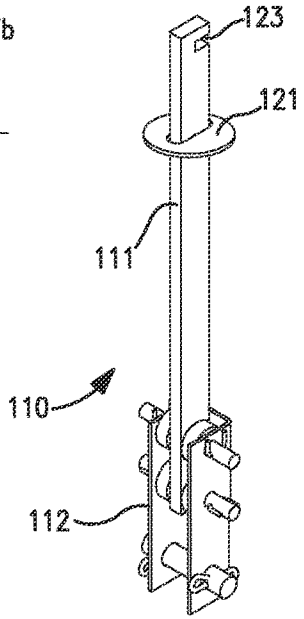
FIG. 10 is a perspective view of an alternate embodiment of the center heating element hanger assembly shown in FIG. 3.
Figure 14:
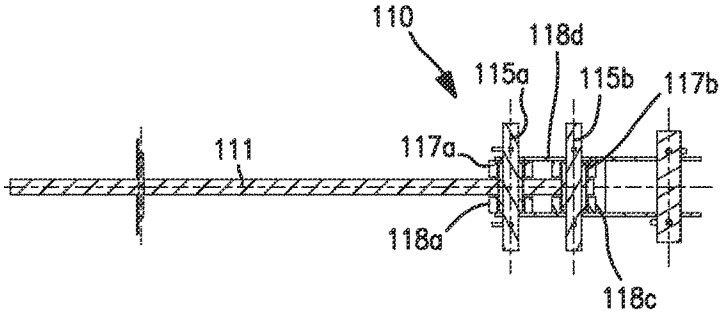
FIG. 14 is a side elevation view in partial cross section of the hanger assembly shown in FIG. 12 as viewed along line 14-14 thereof.
Figure 13:
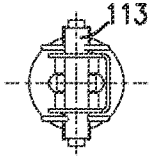
FIG. 13 is a bottom plan view of the hanger assembly shown in FIG. 10.
Figure 11:
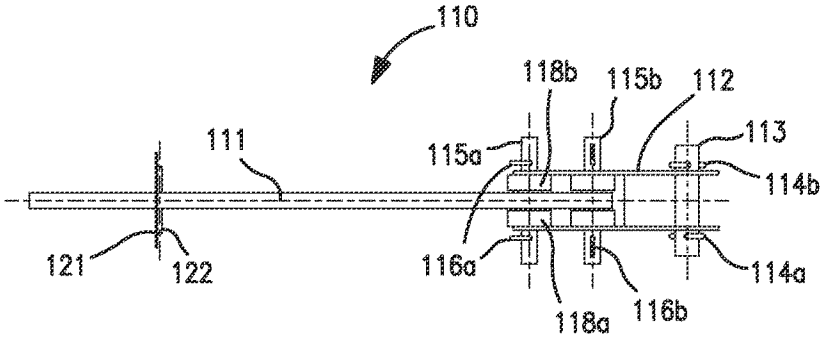
FIG. 11 is an edge view of the hanger assembly shown in FIG. 10.
Figure 12:
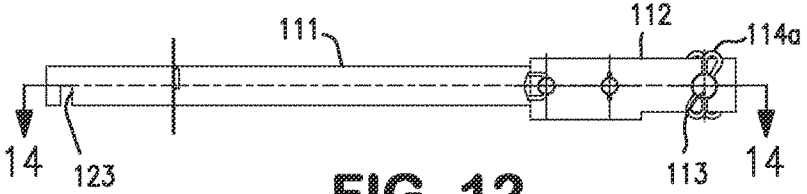
FIG. 12 is a side elevation view of the hanger assembly shown in FIG. 10.

In the embodiment shown in FIG. 4, the center heating element is removed. The heating element segments 38*a*, 38*b*, and 38*c* are connected to heating element segments 40*a*, 40*b*, and 40*c* to form a complete electrical circuit. A jumper segment 38*e* is connected between heating element segments 38*c* and 40*c*, preferably by use of removable/reusable fasteners as described above.

The heating element segments 38*a*-38*d*, 40*a*-40*d*, 42*a*, and 42*b* are preferably formed of graphite as known to those skilled in the art. The heating element segments can be formed of a refractory metal such as molybdenum. When the center heating element 28 is formed of a refractory metal, it is preferred that insulating spacers will be fixedly positioned between the heating element segments 42*a* and 42*b* in order to prevent contact between the segments when the center heating element is energized. The lateral heating elements used in the embodiments described and shown herein can be realized by use of curved graphite heating elements as described in U.S. Pat. No. 5,965,050, the entirety of which is incorporated herein by reference.

Figure 5:
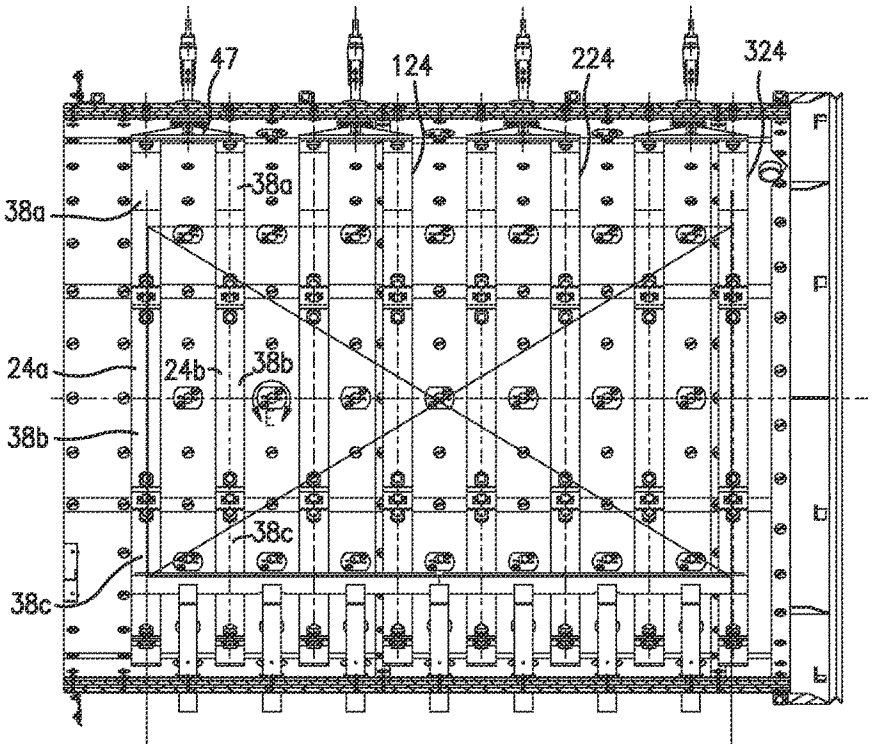
FIG. 5 is a side elevation view in partial cross section of the vacuum heat treating furnace of FIG. 4 as viewed along line 5-5 thereof.

Referring to FIG. 5, there is shown an alternate arrangement of the first heating element 24 used in the heat treating furnace of FIG. 4. In the arrangement shown in FIG. 5, the first heating element 24 has two sub-elements 24*a* and 24*b* electrically connected and arranged in parallel. A connector 47 provides an electrical connection between sub-elements 24*a*, 24*b* and the connector terminal 32. In like manner, although not shown, the second heating (26 in FIG. 1) has two sub-elements (not shown) that are connected in parallel.

Referring now to FIGS. 10-14, there is shown an alternate embodiment of the heating element hanger assembly of FIG. 3. The hanger assembly 110 includes a bar 111 and a bracket 112. Bracket 112 is generally U-shaped in cross section. The hanger assembly 110 also includes a rod 113 that extends through holes in a bottom end of bracket 113. Rod 113 is used for connecting the hanger assembly 110 to the center heating element according to the present invention. Retaining wires 114*a* and 114*b* are used to hold the rod 113 in place. The retaining wires are typically inserted in diametric through-holes at each end of rod 113 and are formed in a manner so as to prevent them from falling out.

Hanger assembly 110 also includes first and second pins 115*a* and 115*b* for attaching the bar 111 to the bracket 112. The pins 115*a* and 115*b* extend through aligned holes in the bar 111 and bracket 112. The pins 115*a* and 115*b* are retained in position with pairs of retaining wires 116*a* and 116*b*, respectively. The retaining wires are typically inserted in diametric through-holes formed in the ends of the pins 115*a* and 115*b* that extend beyond the sides of bracket 112. The bar 111, bracket 112, rod 113, pins 115*a* and 115*b*, the retaining wires 114*a*, 114*b*, 116*a*, and 116*b* are preferably formed of a refractory metal such as molybdenum. In order to electrically insulate the bar 111 from bracket 112, ceramic sleeves 117*a* and 117*b* are positioned around the central portions of the pins 115*a* and 115*b* that extend through the holes in bar 111. In addition, ceramic collars 118*a* and 118*b* are positioned around pin 115*a* so as to prevent contact between bar 111 and the sidewalls of bracket 112. Additional ceramic collars 118*c* and 118*d* are positioned around pin 115*b* between bar 111 and the side walls of bracket 112.

The hanger assembly 110 further includes a disc 121 positioned on bar 111 and retained in position with a retaining wire 122 that extends through a small hole in bar 111. A small notch 123 is formed in bar 111 near the end thereof that is distal from the bracket 112. The disc 121 is positioned at a distance along bar 111 from the notch 123 so that the bar 111 can extend through the hot zone insulation a distance sufficient to allow it to engage with a catch on the hot zone enclosure by twisting the hanger assembly 110. When the hanger assembly 110 is thus installed, the disc 121 abuts the hot zone insulation. The twist-lock feature is described in U.S. Pat. No. 4,321,415, the entirety of which is incorporated herein by reference.

The foregoing text describes the features of a single heating element array in accordance with the present invention. However, as shown in FIGS. 2 and 5, a vacuum furnace according to the present invention may also include two or more heating element arrays. Referring to FIGS. 2 and 5, a further embodiment of the vacuum furnace 10 will have additional heating element arrays positioned within the hot zone 16 and positioned at intervals along the longitudinal axis of the pressure vessel 12. A second heating element array includes a first lateral heating element 124, a second lateral heating element (not shown) and a center heating element 128. A third heating element array includes a first lateral heating element 224, a second lateral heating element (not shown) and a center heating element 228. In addition, a fourth heating array includes a first lateral heating element 324, a second lateral heating element (not shown) and a center heating element 328. This concept can be extended to any desired and effective number of heating element arrays.

In accordance with the present invention it is contemplated that in the heating element arrays, the heating element segments that make up the respective heating element arrays can be formed to provide different electrical resistances or watt densities at different locations in the heating element arrays. This arrangement allows for placement of heating elements having an electrical resistance and/or watt density selected to provide more or less heat as needed in the furnace hot zone to provide better temperature uniformity in the workload. The electrical resistances and watt densities of the heating element arrays are varied by using a first heating element having a geometry in one segment of a heating element array and a second heating element having a different geometry from that of the first heating element in another section of the heating element array. For example, in one embodiment the heating element segments located in an upper region of the hot zone will have a geometry that provides a first watt density and the heating element segments in a lower region of the hot zone will have a different geometry to provide a second watt density having a different magnitude than the first watt density. It is also contemplated that, when more than one heating element array is present in the vacuum furnace of this invention, all of the heating element segments in one heating element array will have the same geometry and all of the heating element segments in another heating element array will have a different geometry. In this manner the radiant heat output from one heating element array will be different from the radiant heat output of another heating element array, whereby the heat applied to the workload will be different in different zones of the vacuum furnace. Thus, for example, the heating element segments in the heating element array nearest the door of the vacuum furnace will have a geometry that provides a watt density sufficient to provide greater heat output than that of an inboard heating element array(s) in the hot zone. This aspect of the invention is described in copending U.S. patent application Ser. No. 13/728,122, the entirety of which is incorporated herein by reference.

It is further contemplated that when multiple heating element arrays are present in a vacuum furnace according to this invention, the heat output of each heating element array can be adjusted or trimmed at the electric power source. This is conventionally realized by use of a variable reactance transformer associated with the electric power source and connected to each one of the heating element arrays in the manner known to those skilled in the art. This aspect of the invention is described in U.S. Patent Application Publication No. 2013/0175256, the entirety of which is incorporated herein by reference.

In view of the foregoing description of preferred embodiments of a vacuum furnace according to the present invention, some of the advantages of the inventive concepts will be apparent to those skilled in the art. For example, the vacuum heat treating furnace according to the present invention includes a center heating element that is operatively connected to an electric power source through two lateral heating elements so that the center heating element is energized without the need for a separate power connection to the center heating element. Also, the center heating element used in the vacuum furnace of this invention is removably connected to the lateral heating elements and to the hot zone enclosure so that the center heating element can be easily removed, thereby permitting the vacuum furnace to be reconfigured for a single large workload to be processed in the vacuum furnace.

The terms and expressions which have been employed are used as terms of description and not of limitation. There is no intention in the use of such terms and expressions of excluding any equivalents of the features or steps shown and described or portions thereof. It is recognized, therefore, that various modifications are possible within the scope and spirit of the invention. For example, the heating element arrangement including a removable center heating element according to the present invention could be adapted for use in a vertical vacuum furnace. Accordingly, the invention incorporates variations that fall within the scope of the invention as described.

The invention claimed is:

1. A vacuum heat treating furnace for the heat treatment of metal parts comprising:

a pressure vessel;

a hot zone enclosure positioned inside said pressure vessel to define a hot zone within the heat treating furnace;

a heating element array positioned inside said hot zone enclosure; and a source of electric energy;

wherein said heating element array comprises:

a first heating element suspended on an inner wall of the hot zone enclosure in a first region of the hot zone, said first heating element having a first end and a second end wherein the first end is connected to the source of electric energy;

a second heating element suspended on the inner wall of the hot zone enclosure in a second region of the hot zone opposite to the first region, said second heating element having a first end and a second end, wherein the first end is connected to the source of electric energy; and a center heating element suspended from the hot zone enclosure along a vertical chord of said hot zone enclosure between said first and second heating elements such that a) a first workload can be positioned with said center heating element facing one side of the first workload and with said first heating element facing an opposing second side of the first workload; and b) a second workload can be positioned with said center heating element facing a first side of the second workload and with said second heating element facing an opposing second side of the second workload, said center heating element having first and second connection terminals at a first end thereof and a second end thereof, wherein the first connection terminal is connected to the second end of the first heating element and the second connection terminal is connected to the second end of the second heating element, whereby the center heating element is connected to the source of electric energy through said first and second heating elements; and a hanger assembly having a first end attached to the top of the hot zone enclosure and a second end connected to the second end of the center heating element whereby the center heating element is suspended from the hot zone enclosure.

2. The vacuum heat treating furnace as claimed in claim 1 wherein the center heating element comprises:

first and second sub-elements each having first and second ends, wherein the first connection terminal is formed on the first end of the first sub-element, the second terminal connection is formed on the first end of the second sub-element, and the second ends of the first and second sub-elements are connected together.

3. The vacuum heat treating furnace as claimed in claim 2 comprising a first removable/reusable fastener that attaches the first end of the first sub-element to the second end of the first heating element and a second removable/reusable fastener that attaches the first end of the second sub-element to the second end of the second heating element.

4. The vacuum heat treating furnace as claimed in claim 3 wherein the first removable/reusable fastener comprises:

a first threaded stud inserted through aligned holes in the first end of the first sub-element and the second end of the first heating element, and first and second nuts threaded onto opposing ends of the first threaded stud; and the second removable/reusable fastener comprises:

a second threaded stud inserted through aligned holes in the first end of the second sub-element and the second end of the second heating element, and third and fourth nuts threaded onto opposing ends of the second threaded stud.

5. The vacuum heat treating furnace as claimed in claim 1 comprising:

a first removable/reusable fastener that attaches the first terminal connection to the second end of the first heating element and a second removable/reusable fastener that attaches the second terminal connection to the second end of the second heating element.

6. The vacuum heat treating furnace as claimed in claim 1 comprising a second heating element array positioned inside said hot zone enclosure and spaced from the heating element array along a longitudinal axis of the pressure vessel, wherein said second heating element array comprises:

a third heating element suspended on an inner wall of the hot zone enclosure in the first region of the hot zone, said third heating element having a first end and a second end wherein the first end is connected to a second source of electric energy;

a fourth heating element suspended on the inner wall of the hot zone enclosure in the second region of the hot zone, said fourth heating element having a first end and a second end, wherein the first end is connected to the second source of electric energy;

and a second center heating element suspended from the inner wall of the hot zone enclosure along a second vertical chord of said hot zone enclosure between said third and fourth heating elements such that a) the first workload can be positioned with said second center heating element facing the one side of the first workload and said third heating element facing the opposing second side of the first workload, and b) the second workload can be positioned with said second center heating element facing the one side of the second workload and said fourth heating element facing the opposing second side of the second workload, said second center heating element having first and second connection terminals at a first end thereof and a second end, wherein the first connection terminal is connected to the second end of the third heating element and the second connection terminal is connected to the second end of the fourth heating element, whereby the second center heating element is connected to the second source of electric energy only through said third and fourth heating elements; and the second heating element array further comprises a second hanger assembly having a first end attached to the top of the hot zone enclosure and a second end connected to the second end of the second center heating element.

7. The vacuum heat treating furnace as claimed in claim 6 wherein the first and second vertical chords are diameters of the hot zone enclosure.

8. The vacuum heat treating furnace as claimed in claim 1 wherein the vertical chord is a diameter of the hot zone enclosure.

9. A method of configuring the vacuum heat treating furnace to hold a workload of the metal parts, wherein the vacuum heat treating furnace comprises a pressure vessel; a hot zone enclosure positioned inside said pressure vessel to define a hot zone within the heat treating furnace; a heating element array positioned inside said hot zone enclosure; and a source of electric energy; wherein said heating element array comprises: a first heating element suspended on an inner wall of the hot zone enclosure in a first region of the hot zone, said first heating element having a first end and a second end wherein the first end is connected to the source of electric energy; a second heating element suspended on the inner wall of the hot zone enclosure in a second region of the hot zone opposite to the first region, said second heating element having a first end and a second end, wherein the first end is connected to the source of electric energy; and a center heating element suspended from the hot zone enclosure along a vertical chord of said hot zone enclosure between said first and second heating elements such that a first workload can be positioned with said center heating element facing one side of the first workload and said first heating element facing an opposing second side of the first workload and a second workload can be positioned with said center heating element facing one side of the second workload and said second heating element facing an opposing second side of the second workload, said center heating element having first and second connection terminals at a first end thereof and a second end, wherein the first connection terminal is connected to the second end of the first heating element and the second connection terminal is connected to the second end of the second heating element, whereby the center heating element is connected to the source of electric energy through said first and second heating elements; and a hanger assembly having a first end attached to the top of the hot zone enclosure and a second end connected to the second end of the center heating element whereby the center heating element is suspended from the hot zone enclosure; wherein said method comprises the steps of: disconnecting the center heating element from the first and second heating elements; removing the center heating element from the vacuum heat treating furnace; and then connecting a jumper heating element between the second end of the first heating element and the second end of the second heating element, whereby an electrical conduction path is established between the first and second heating elements.

10. The method of configuring a vacuum heat treating furnace as set forth in claim 9 comprising the further steps of disconnecting the jumper heating element from the first and second heating elements, suspending the center heating element from the hot zone enclosure, and then reconnecting the center heating element to the first and second heating elements.

* * * * *